US006761568B2

(12) United States Patent
Bakker et al.

(10) Patent No.: US 6,761,568 B2
(45) Date of Patent: Jul. 13, 2004

(54) ELECTRICAL CONNECTOR ASSEMBLY

(75) Inventors: John H. Bakker, Cortland, OH (US); Ronald A. Puhl, Poland, OH (US); Courtney A. Mansky, Youngstown, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/350,665

(22) Filed: Jan. 24, 2003

(65) Prior Publication Data

US 2003/0119349 A1 Jun. 26, 2003

Related U.S. Application Data

(63) Continuation-in-part of application No. 10/159,174, filed on May 31, 2002, which is a continuation-in-part of application No. 09/795,692, filed on Feb. 27, 2001, now Pat. No. 6,422,881.

(51) Int. Cl.[7] ..... H01R 13/44
(52) U.S. Cl. ..... 439/140
(58) Field of Search ..... 439/140, 141, 439/752, 598

(56) References Cited

U.S. PATENT DOCUMENTS

| | | | |
|---|---|---|---|
| 5,501,606 | A | 3/1996 | Oda et al. |
| 6,086,385 | A | 7/2000 | Wang et al. |
| 6,142,813 | A | 11/2000 | Cummings et al. |
| 6,162,085 | A | 12/2000 | Chugh et al. |
| 6,171,146 | B1 | 1/2001 | Fink et al. |
| 6,179,658 | B1 | 1/2001 | Gunay et al. |
| 6,203,364 | B1 | 3/2001 | Chupak et al. |
| 6,208,233 | B1 | 3/2001 | Stein, Sr. et al. |
| 6,247,951 | B1 | 6/2001 | Di Liello et al. |
| 6,247,965 | B1 | 6/2001 | Cummings et al. |
| 6,305,957 | B1 | 10/2001 | Fink et al. |
| 6,338,651 | B1 | 1/2002 | Svette, Jr. et al. |
| 6,345,706 | B1 | 2/2002 | Oliver et al. |
| 6,406,307 | B2 | 6/2002 | Bungo et al. |
| 6,422,881 | B1 | 7/2002 | Puhl et al. |
| 6,443,137 | B1 | 9/2002 | Kraft et al. |
| 6,454,060 | B1 | 9/2002 | Lisenker et al. |
| 6,494,751 | B1 | 12/2002 | Morello et al. |
| 6,508,666 | B1 | 1/2003 | Francis |
| 6,533,588 | B1 | 3/2003 | Woith et al. |
| 6,533,611 | B2 | 3/2003 | Morello et al. |
| 6,535,396 | B1 | 3/2003 | Degenkolb et al. |
| 6,556,118 | B1 | 4/2003 | Skinner |
| 6,565,372 | B2 | 5/2003 | Bakker et al. |
| 6,578,444 | B1 | 6/2003 | Wendelin |

*Primary Examiner*—Javaid H. Nasri
(74) *Attorney, Agent, or Firm*—David P. Wood

(57) ABSTRACT

An electrical connector assembly has a male connector which mates to a female connector thereby electrically engaging male terminal blades, locked to a male connector body, to female terminals locked to a female connector body. The blade of each male terminal extends into a blind bore defined by a shroud of the male connector body. Prior to mating of the electrical connector assembly, a self-aligning blade stabilizer is snap fitted into a blade alignment position with the male connector via a lock arm which prevents withdrawal of the stabilizer from the male connector and a flex arm which restricts insertion of the stabilizer into the male connector. When the stabilizer is in the blade alignment position, the tips of the blades are disposed within respective apertures of the stabilizer and aligned to their respective female terminals. Moreover, the terminal blades are protected from being inadvertently knocked and bent which would cause blade misalignment and hinder electrical continuity of the mated assembly. Furthermore, the stabilizer prevents entry of debris into the blind bore of the male connector which would hinder or prevent full mating of the electrical connector. During mating of the electrical connector assembly, the stabilizer is pushed out of the blade alignment position and into a seated position as the blades travel through the apertures and into the female terminals of the female connector.

14 Claims, 5 Drawing Sheets

ELECTRICAL CONNECTOR ASSEMBLY

RELATED PATENT APPLICATION

This is a continuation-in-part application of U.S. patent application Ser. No. 10/159,174, filed May 31, 2002, which is a continuation in part of U.S. application Ser. No. 09/795,692, filed Feb. 27, 2001 (U.S. Pat. No. 6,422,881 B1).

TECHNICAL FIELD

The present invention relates to an electrical connector assembly, and more particularly to an electrical connector assembly having a pre-aligning terminal blade stabilizer.

BACKGROUND OF THE INVENTION

A multi-bladed electrical connector has a male connector portion which firmly supports a series of male terminals that are locked within respective terminal cavities of the male connector portion. A female connector portion of the electrical connector mates typically via a snap locking feature to the male connector portion. When mating, the pins are received by respective pin receptacles of the female connector portion to form the electrical connections.

A blade or pin of each terminal projects forward from each terminal cavity and into a common blind bore or chamber defined by a forward projecting circumferential encasement or shroud of the male connector portion. The female connector portion of the electrical connector houses the series of pin receptacles which communicate through a leading end of the female connector portion. For a reliable electrical connection, each pin receptacle must align with its respective pin of the terminal of the male connector portion. When the electrical connector is mated, the leading end portion of the female connector portion fits into the chamber of the male connector portion and is thus guided by the circumferential encasement.

Unfortunately, during the manufacturing phase and/or handling of a wire harness, which is engaged to the male connector portion of the electrical connector, the exposed protruding pins of the terminals can potentially be knocked or bent, or debris may enter the chamber of the male connector portion which results in the inability of the terminals to connected electronically within the pin receptacles of the female connector portions. Moreover, the manufacturing dimensional variances between the terminals and the male connector portion housing cause the terminals to pivot slightly within the housing and the distal ends of the pins to become misaligned with the receptacles.

SUMMARY OF THE INVENTION

An electrical connector assembly has a male connector which mates to a female connector thereby electrically engaging male terminal blades, locked to a male connector body, to female terminals locked to a female connector body. The blade of each male terminal extends into a blind bore defined by a shroud of the male connector body. Prior to mating of the electrical connector assembly, a self-aligning blade stabilizer is snap fitted into a blade alignment position with the male connector via a lock arm which prevents withdrawal of the stabilizer from the male connector and a flex arm which restricts insertion of the stabilizer into the male connector. When the stabilizer is in the blade alignment position, the tips of the blades are disposed within respective apertures of the stabilizer and aligned to their respective female terminals. Moreover, the terminal blades are protected from being inadvertently knocked and bent which would cause blade misalignment and hinder electrical continuity of the mated assembly. Furthermore, the stabilizer prevents entry of debris into the blind bore of the male connector which would hinder or prevent full mating of the electrical connector. During mating of the electrical connector assembly, the stabilizer is pushed out of the blade alignment position and into a seated position as the blades travel through the apertures and into the female terminals of the female connector.

An advantage of the present invention is the prevention of accidental mis-alignment or bending of the protruding blades of the terminals of the male connector portion. Another advantage of the present invention is the elimination of foreign article or debris collection within the chamber of the male connector portion which could prevent full mating of the electrical connector. Yet another advantage of the invention is the incorporation of a blade stabilizer having a blade alignment position without having to re-design the male or female connector of the electrical connector assembly.

BRIEF DESCRIPTION OF THE DRAWINGS

The presently preferred embodiment of the invention is disclosed in the following description and in the accompanied drawings, wherein.

DETAILED DESCRIPTION OF THE PREFERRED EMBODIMENTS

Figure 1:
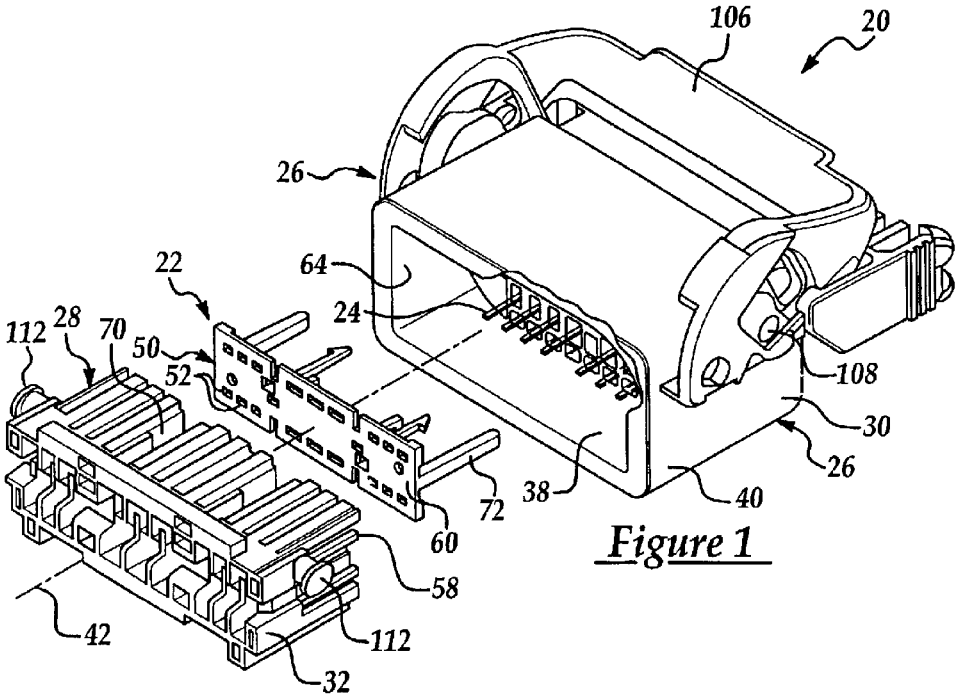
FIG. 1 is an exploded perspective view of the electrical connector assembly of the present invention.

Referring now to the drawings, FIG. 1 illustrates a multi-pin electrical connector assembly 20 having a self-aligning, dual-positioning, pin or blade stabilizer 22 which ensures reliable electrical connection of the assembly by pre-aligning a series of terminal blades 24 of a male connector 26 to a series of non-ferrous contacts or female terminals (not shown) of a female connector 28. The male terminals are carried by and locked to a plastic body 30 of the male connector 26 and the female terminals are locked to a plastic body 32 of the female connector 28.

Figure 2:
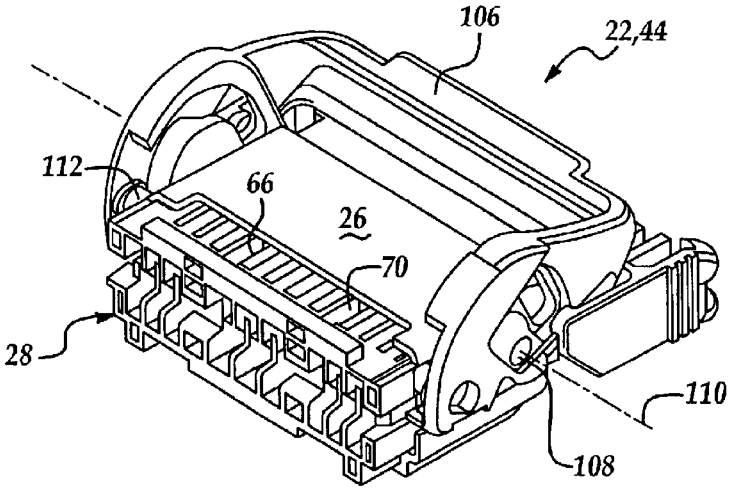
FIG. 2 is a perspective view of the connector assembly in an un-mated position.
Figure 3:
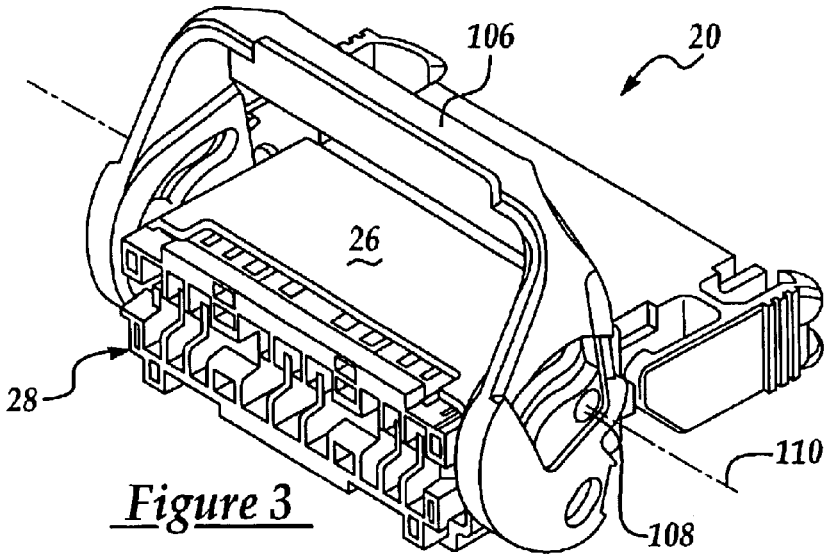
FIG. 3 is a perspective view of the connector assembly in an un-mated position and further illustrates a lock lever being pivoted to mate the connector assembly.
Figure 4:
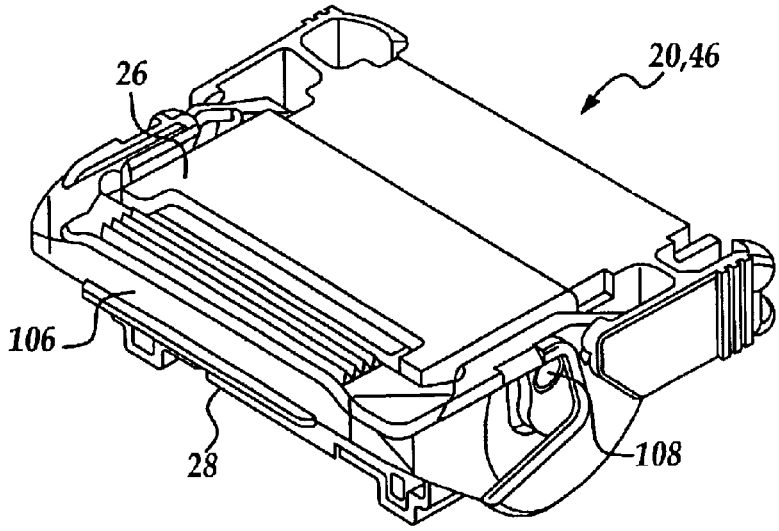
FIG. 4 is a perspective view of the connector assembly in a mated position.
Figure 5:
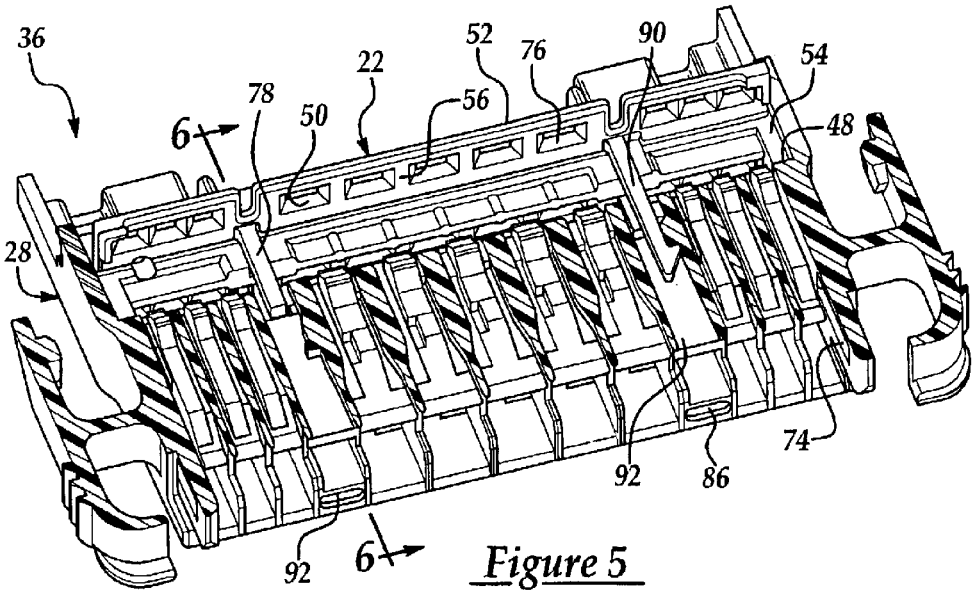
FIG. 5 is a perspective cross section view of a male connector and a stabilizer of the connector assembly shown in a blade alignment position.
Figure 6:
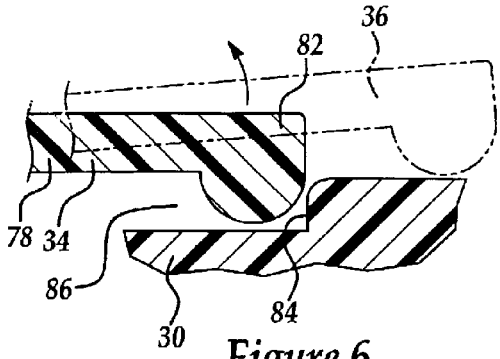
FIG. 6 is an enlarged cross section view of a flex arm of the stabilizer shown engaged releasably to a shelf of the male connector.
Figure 8:
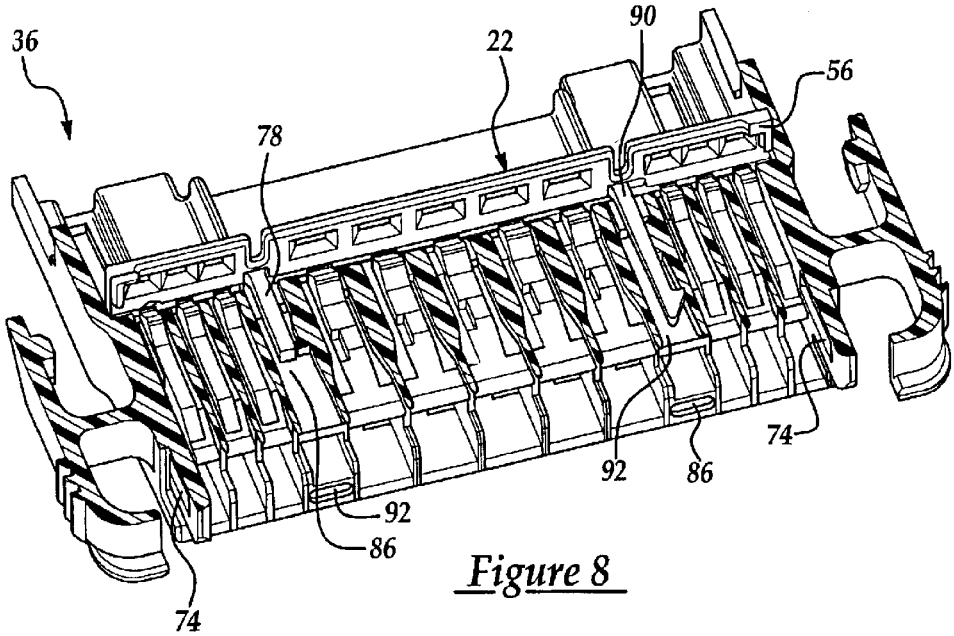
FIG. 8 is a perspective cross section view of the male connector and the stabilizer shown in a seated position.
Figure 9:
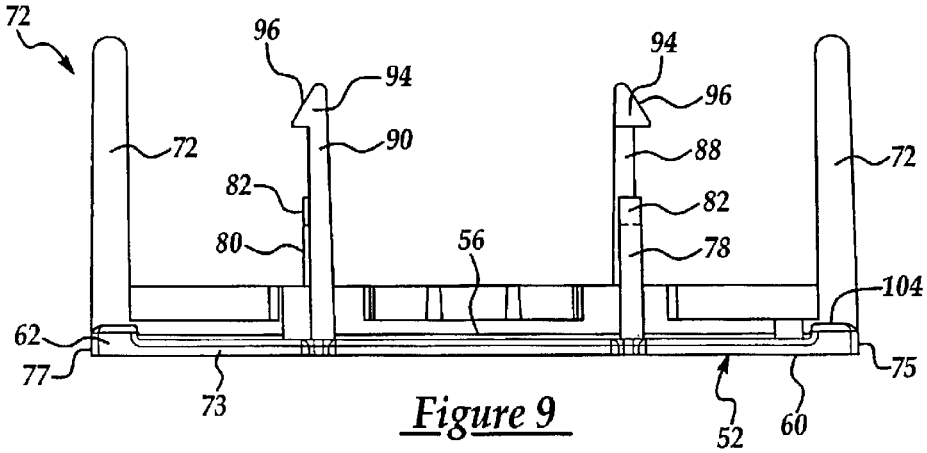
FIG. 9 is a side view of the stabilizer.
Figure 10:
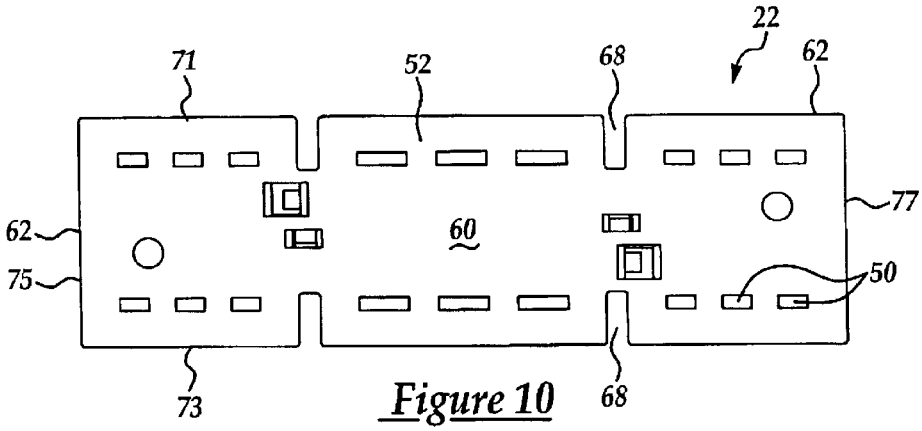
FIG. 10 is trailing view of the stabilizer.
Figure 11:
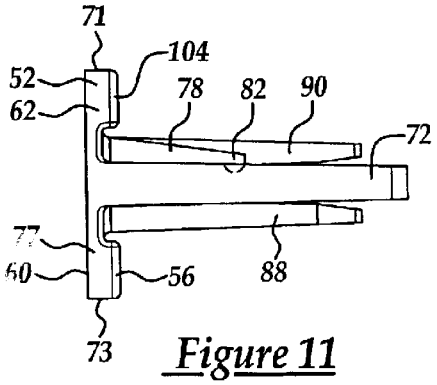
FIG. 11 is an end view of the stabilizer.
Figure 12:
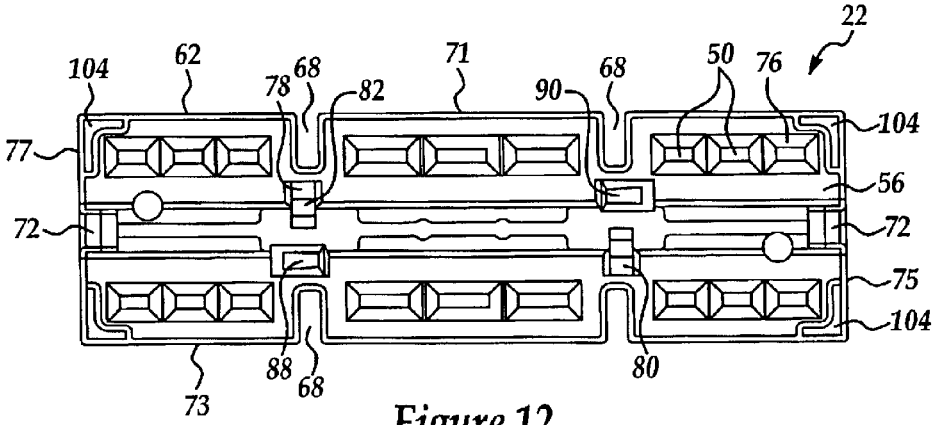
FIG. 12 is a leading view of the stabilizer.

The plastic blade stabilizer 22 has a blade alignment position 34 which pre-aligns and protects the blades 24, as best shown in FIG. 5, and a fully seated position 36, as best shown in FIG. 8. In both positions 34, 36, the stabilizer 22 is disposed within a blind bore or alcove 38 defined by a forward projecting circumferential housing or shroud 40 of the male connector body 30. During the mating process, the body 32 of the female connector 28, which is contoured to snugly fit inside the shroud 40, slides along a mating axis 42 into the blind bore 38 from an un-mated position 44, as best shown in FIG. 2, to a fully mated position 46, as best shown in FIG. 4. When mating, the stabilizer 22 is pushed by the mating connectors 26, 28 from the blade alignment position 34 to the seated position 36.

Referring to FIGS. 1, 5, and 8–12, the terminal blades 24 project axially forward from a leading face 48 of the body 30, which defines the bottom of the blind bore 38, and through respective apertures 50 of a base plate 52 of the stabilizer 22 disposed substantially perpendicular to the mating axis 42. When the stabilizer 22 is in the blade alignment position 34, only the distal ends or tips of the blades 24 extend through the apertures 50. The remaining portion of the blades 24 are protected within a void 54 of the blind bore 38 defined axially between a leading surface 56 of the base plate 52 and the leading face 48 of the male connector body 30. The base plate 52 of the stabilizer 22 in combination with the shroud 40 prevents the blades 24 from being knocked or bent prior to mating and prevents debris from entering the void 54 which could prevent proper mating of the electrical connector assembly 20. After the stabilizer 22 is placed in the blade alignment position 34, and during the mating process of the connectors 26, 28, a leading face 58 of the female connector body 32 through which the female terminals are exposed, contacts an opposite trailing surface 60 of the base plate 52 of the stabilizer 22 and pushes the stabilizer 22 further into the blind bore 38 as the blades 24 extend further through the apertures 50 to electrically contact the female terminals of the female connector 28. When the stabilizer 22 is in the fully seated position 36, the blades 24 are fully extended through the apertures 50, the void 54 is eliminated, and the leading surface 56 is in contact with the leading face 48 of the male connector body 30.

Referring to FIGS. 9–12, the base plate 52 of the stabilizer 22 is substantially rectangular in shape. A peripheral edge 62 of the base plate 52 therefore carries a long first side 71, an opposite long second side 73, a short third side 75 and an opposite short fourth side 77. The blind bore 38 is defined by an inner wall 64 and is also substantially rectangular in shape so that the sides 71, 73, 75, 77 are closely fitted to the inner wall 64.

Referring to FIGS. 5 and 8–12, the stabilizer 22 has two slightly tapered guide bars 72 projecting axially from the leading surface 56 of the base plate 52 adjacent to and near the center of the third and fourth sides 75, 77 of the peripheral edge 62. When initially inserting the stabilizer 22 into the blind bore 38 of the male connector body 30, the guide bars 72 fit into respective borings or guide ways 74 carried by the body 30. Because the guide bars 72 are tapered, the initial fit is loose, however, the fit soon tightens as the stabilizer is further inserted into the blind bore 38 and before the terminal blades 24 axially align to the apertures 50 of the base plate 52. The tight fit of the guide bars 72 with the guide ways 74, along with beveled edges 76 of the apertures 50 carried by the leading surface 56 assure the tips of the blades 24 align and extend through the apertures 50. Without such an alignment, the blades 24 could potentially bend thus damaging the assembly 20.

Referring to FIGS. 5, 6 and 8–12, also projecting axially from the leading surface 56 of the base plate 52 are first and second flex arms 78, 80 which flex resiliently in a substantially vertical and radial outward direction. The first flex arm 78 flexes upward and is generally diametrically opposed to the second flex arm 80 which flexes downward. The first flex arm 78 is positioned near the first and fourth sides 73, 77, and the second flex arm 80 is kitty-cornered or positioned near the second and third sides 73, 75. The first flex arm 78 has a rounded distal end or an enlarged, rounded, distal head 82 which projects laterally substantially downward or inward and the second flex arm 80 has the same type of head 82 which projects substantially laterally upward or inward. Prior to the flex arms 78, 80 flexing, each distal head 82 engages or embarks upon a respective stop or leading shelf 84 when the stabilizer 22 is in the blade alignment position 34. The shelves 84 lie within a common imaginary plane disposed substantially perpendicular to the mating axis 42, are carried by the male connector body 30, and are disposed within an axially extending hole 86 defined by the connector body 30. The contact of the distal heads 82 with the shelves 84 provide a resilience which prevents movement of the stabilizer 22 from the blade alignment position 34 to the seated position 36 without an axial force attributed by the mating of the two connectors 26, 28.

Figure 7:
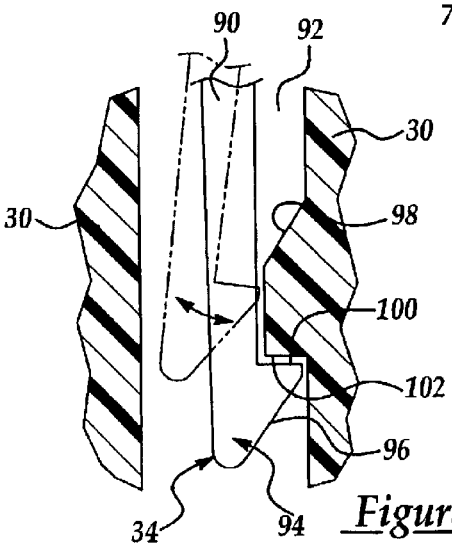
FIG. 7 is an enlarged cross section view of a lock arm of the stabilizer shown engaged releasably to a trailing stop face of the male connector.

Referring to FIGS. 5–12, a first and a second alignment lock arm 88, 90 of the stabilizer 22 prevents the stabilizer from being pulled out of the male connector 26 after the stabilizer snap locks into the blade alignment position 34. Like the flex arms 78, 80, the lock arms 88, 90 project axially from the leading surface 56 of the base plate 52. The first lock arm 88 is positioned near the second and fourth sides 73, 77, and the second lock arm 90 is kitty-cornered or positioned near the first and third sides 71, 75. During insertion of the stabilizer 22 into the male connector 26 and substantially simultaneously to when the guide bars 72 become almost fitted snugly within the guide ways 74, the lock arms 88, 90 initially enter respective channels 92 defined by the male connector body 30. Each lock arm 88, 90 has a distal catch head 94 having a leading ramped surface 96 which slideably engages an opposing leading ramped face 98 of the male connector body 30 which is exposed within the respective channels 92. This contact, along with continued insertion of the stabilizer 22, causes the lock arms 88, 90 to resiliently flex substantially toward one another in a substantially radially inward direction that is generally perpendicular to the flex direction of the flex arms 78, 80. With continued insertion of the stabilizer 22, the lock arms 88, 90 will snap back to an unflexed state when the stabilizer reaches the blade alignment position 34 and the heads 82 of the flex arms 78, 80 are in close proximity, or in contact with, the respective shelves 84. When the stabilizer 22 is in the blade alignment position 34, a trailing stop surface 100 of the catch head 94 engages a trailing stop face 102 carried by the male connector body 30 within the channel 92, thereby preventing the stabilizer 22 from being pulled out and away from the male connector 26, as best shown in FIGS. 5 and 7.

Stresses exerted upon the base plate 52 of the stabilizer 22 are distributed temporally and spatially to prevent warpage of the base plate 52 which could otherwise mis-align or bend the terminal blades 24 of the male connector 26. The temporal stress distribution is contributed by the length of the guide bars 72 which are longer than the lock arms 88, 90. This length difference enables the guide bars 72 to first engage the male connector body 30, thereby using the body to help provide rigidity to the base plate 52 before and during the flexing of the lock arms 88, 90 just prior to the lock arms snap locking to the male connector body 30 and into the blade alignment position 34. The potential for twisting of the elongated base plate 52 and/or bowing of the plate is thus eliminated. Moreover, the flexing of the lock arms 88, 90 occurs at a different time than the flexing of the flex arms 78, 80. That is, the lock arms 88, 90 are only in the flexed state when the stabilizer is moving into the blade alignment position 34 and the flex arms 78, 80 are only in the flexed state when the stabilizer 22 is moving from the blade alignment position 34 to the seated position 36.

In terms of spatial stress distribution, the two guide bars 72 are disposed diametrically at the outer fringes of the base plate 52 which would otherwise be most prone to warpage from the reactive forces contributed by the flex arms 78, 80 and the lock arms 88, 90. Similarly, the flex arms 78, 80 are spaced generally diametrically away from one another and the lock arms 88, 90 are spaced diametrically away from one another. Also, the respective reactive forces contributed to the flexing of each flex arm 78, 80 substantially cancel each other out because the direction of flex of the first flex arm 78 is opposite to the direction of flex of the second flex arm 80. Likewise, the respective reactive forces contributed to the flexing of each lock arm 88, 90 substantially cancel each other out because the direction of flex of the first lock arm 88 is opposite to the direction of flex of the second lock arm 90. The symmetric and diametric positioning of the notches 68, the guide bars 72, the flex arms 78, 80 and the lock arms 88, 90 enable dual, one hundred and eighty degree insertion of the stabilizer 22 into the male connector body 30. That is, the stabilizer 22 can be flipped by one hundred and eighty degrees and still operatively fit into the body 30.

To further reinforce the base plate 52 and increase stability of the stabilizer 22 when in the blade alignment position 34, angled shoulders or stiffeners 104 project unitarily from the leading surface 56 of the base plate 52 at each corner adjacent to the peripheral edge 62.

To prevent incorrect insertion of the female connector 28 into the blind bore 38, an axial extending key feature is arranged between the peripheral edge 62 of the base plate 52, an outer radial surface of the female connector body 32, and the inner wall 64 of the shroud 40. The key feature includes axial extending ribs or rails 66 of the male connector body 30 which project radially inward from the inner wall 64, as best shown in FIG. 2. The first side 71 of the peripheral edge 62 of the base plate 52 carries two corresponding notches 68 to slideably receive the ribs 66. Correct insertion of the female connector body 32 into the male connector body 30 is also assured along with providing overall assembly 20 rigidity by the same rib 66 and an axially extending groove 70 carried by the female connector body 32. The second side 73 also defines two notches 68 which permit dual insertion of the stabilizer, previously described.

Referring to FIGS. 1–4, the electrical connector assembly 20 has a cam lever 106 engaged pivotally to a pair of opposite posts 108 which lie along a pivoting axis 110 disposed perpendicular to the mating axis 42. A pair of cam followers 112 project laterally outward from the female connector body 32. The followers 112 interact with the cam lever 106 so that pivoting of the lever 106 causes the female connector 28 to move toward the male connector 26 along the mating axis 42. This cam lever feature is described in U.S. Pat. No. 5,810,612, issued Sep. 22, 1998 and is incorporated herein by reference.

While the forms of the invention herein disclosed constitute presently preferred embodiments, many others are possible. It is not limited herein to mention all the possible equivalent forms or ramifications of the invention. It is understood that the terms used herein are merely descriptive rather than limiting and that various changes may be made without departing from the spirit or scope of the invention.

What is claimed is:

1. An electrical connector assembly comprising:

a mating axis;

a male connector having a terminal blade and a body having a leading face, wherein the terminal blade projects forward from the leading face;

a female connector constructed and arranged to electrically engage the terminal blade along the mating axis, the female connector having a leading face which faces the leading face of the body of the male connector;

a blade stabilizer disposed between the leading face of the female connector and the leading face of the male connector, the blade stabilizer having a blade alignment position when the electrical connector assembly is not mated, a seated position when the connector assembly is mated, and an aperture communicating axially, wherein the terminal blade extends through the aperture when the blade stabilizer is in the blade alignment position, and wherein the terminal blade extends through the aperture when the blade stabilizer is in the seated position;

wherein a void for protecting the terminal blade exists when the blade stabilizer is in the blade alignment position and is defined axially between the leading surface of the blade stabilizer and the leading face of the body of the male connector; and wherein the leading face of the body of the male connector is engaged to the leading surface of the blade stabilizer when the blade stabilizer is in the seated position.

2. The electrical connector assembly set forth in claim 1 comprising:

a shroud projecting axially forward from the leading face of the body of the male connector;

a blind bore radially defined by the shroud; and a body of the female connector disposed within the blind bore when the connector assembly is mated.

3. The electrical connector assembly set forth in claim 2 comprising:

a base plate of the blade stabilizer disposed perpendicular to the mating axis, wherein the base plate carries the leading surface and defines the aperture;

a guide bar of the blade stabilizer projecting axially from the leading surface of the base plate; and a guide way defined by the body of the male connector, wherein the guide bar is disposed within the guide way when the blade stabilizer is in the blade alignment position and in the seated position.

4. The electrical connector assembly set forth in claim 3 wherein the guide bar is tapered.

5. The electrical connector assembly set forth in claim 2 comprising:

a base plate of the blade stabilizer disposed perpendicular to the mating axis, wherein the base plate carries the leading surface and defines the aperture;

a lock arm of the blade stabilizer projecting axially from the leading surface of the base plate, the lock arm having a trailing stop surface;

an axially extending channel carried by the body of the male connector wherein the lock arm is disposed within the channel when the stabilizer is in the blade alignment position and the seated position; and a trailing stop face of the body of the male connector disposed within the channel, the trailing stop face being in contact with the trailing stop surface when the stabilizer is in the blade alignment position for preventing disengagement of the stabilizer from the male connector.

6. The electrical connector assembly set forth in claim 5 wherein the lock arm has an enlarged distal catch head which carries the trailing stop surface.

7. The electrical connector assembly set forth in claim 6 comprising:

a leading ramped surface of the distal catch head;

a leading ramped face of the body of the male connector disposed within the channel and disposed forward of the trailing stop face; and wherein the leading ramped surface of the distal catch head slideably engages the leading ramped face of the male connector causing the lock arm to flex when the lock arm is initially inserted into the channel and prior to the stabilizer snap locking into the blade alignment position.

8. The electrical connector assembly set forth in claim 5 comprising:

a guide bar of the blade stabilizer projecting axially from the leading surface of the base plate;

a guide way defined by the body of the male connector, wherein the guide bar is disposed within the guide way when the blade stabilizer is in the blade alignment position and in the seated position; and wherein the guide bar is longer than the lock arm.

9. The electrical connector assembly set forth in 2 comprising:

a base plate of the blade stabilizer disposed perpendicular to the mating axis, wherein the base plate carries the leading surface and defines the aperture;

a flex arm projecting axially from the leading surface of the base plate; and an axially extending hole and a forward facing shelf of the body of the male connector, wherein the flex arm is un-flexed and in contact with the shelf when the stabilizer is in the blade alignment position.

10. The electrical connector assembly set forth in claim 9 wherein the flex arm has an enlarged partially rounded distal head which engages the shelf when the stabilizer is in the blade alignment position and slides past the shelf resiliently flexing the flex arm when the stabilizer moves from the blade alignment position to the seated position.

11. An electrical connector assembly comprising:

a first connector having a leading face disposed perpendicular to the mating axis, an axially extending hole defined by the first connector and communicating through the leading face, an axially extending channel defined by the connector and communicating through the leading face, a trailing stop face disposed within the channel;

a stabilizer having a blade alignment position, a seated position, a leading surface which faces the leading face of the first connector, a first flex arm projecting axially from the leading surface and a first lock arm projecting axially from the leading surface;

wherein the first flex arm releasably engages a forward facing shelf of the first connector disposed within the hole when the stabilizer is in the blade alignment position; and wherein the first lock arm has a trailing stop surface being releasably engaged to the trailing stop face when the stabilizer is in the blade alignment position for preventing disengagement of the stabilizer from the first connector.

12. The electrical connector assembly set forth in claim 11 comprising:

a second flex arm being diametrically opposed to the first flex arm, wherein the first and second flex arms flex in a direction opposite to one another; and a second lock arm being diametrically opposed to the first lock arm, wherein the first and second flex arms flex in a direction opposite to one another.

13. The electrical connector assembly set forth in claim 12 wherein the direction of flex of the first and second flex arms is perpendicular to the direction of flex of the first and second lock arms.

14. The electrical connector assembly set forth in claim 11 comprising:

a mating axis;

a second connector mated to the first connector along the mating axis, wherein the stabilizer is disposed axially between the first and second connectors; and a pivoting cam lock lever assembly having a lock lever engaged pivotally to one connector and a cam follower engaged to the other connector, wherein the cam lock lever is engaged to the follower and rotary movement of the lever causes the connectors to move linearly along the mating axis to mate the connectors and move the stabilizer from the blade alignment position to the seated position.

* * * * *